US007063144B2

(12) United States Patent
Abramov et al.

(10) Patent No.: US 7,063,144 B2
(45) Date of Patent: Jun. 20, 2006

(54) ACOUSTIC WELL RECOVERY METHOD AND DEVICE

(75) Inventors: Oleg Abramov, Moscow (RU); Vladimir Abramov, Moscow (RU); Alfredo Alejandro Zolezzi-Garreton, Santiago (CL); Luis Orlando Paredes Rojas, Santiago (CL); Andrey Pechkov, Moscow (RU)

(73) Assignee: Klamath Falls, Inc., Tortola (VG)

( * ) Notice: Subject to any disclaimer, the term of this patent is extended or adjusted under 35 U.S.C. 154(b) by 133 days.

(21) Appl. No.: 10/615,230

(22) Filed: Jul. 8, 2003

(65) Prior Publication Data

US 2005/0006088 A1 Jan. 13, 2005

(51) Int. Cl.
*E21B 28/00* (2006.01)
*E21B 43/25* (2006.01)

(52) U.S. Cl. ..... 166/249; 166/177.1; 166/177.2; 166/369

(58) Field of Classification Search ..... 166/249, 166/177.1, 177.2, 311, 369
See application file for complete search history.

(56) References Cited

U.S. PATENT DOCUMENTS

| | | | | | |
|---|---|---|---|---|---|
| 2,700,422 | A | * | 1/1955 | Bodine, Jr. | 166/249 |
| 3,303,782 | A | * | 2/1967 | Bodine, Jr. | 417/53 |
| 3,583,677 | A | * | 6/1971 | Phillips | 366/120 |
| 3,648,769 | A | | 3/1972 | Sawyer | |
| 3,721,297 | A | | 3/1973 | Challacombe | |
| 3,990,512 | A | | 11/1976 | Kuris | |
| 4,280,557 | A | | 7/1981 | Bodine | |
| 4,343,356 | A | | 8/1982 | Riggs et al. | |
| 4,345,650 | A | * | 8/1982 | Wesley | 166/249 |
| 4,538,682 | A | | 9/1985 | McManus et al. | |
| 5,184,678 | A | | 2/1993 | Pechkov et al. | |
| 5,595,243 | A | | 1/1997 | Maki, Jr. et al. | |
| 5,753,812 | A | * | 5/1998 | Aron et al. | 73/152.47 |
| 5,994,818 | A | | 11/1999 | Abramov et al. | |
| 6,012,521 | A | * | 1/2000 | Zunkel et al. | 166/249 |
| 6,105,712 | A | * | 8/2000 | Lieng et al. | 181/114 |
| 6,230,799 | B1 | | 5/2001 | Slaughter et al. | |
| 6,279,653 | B1 | | 8/2001 | Wegener et al. | |
| 6,405,796 | B1 | | 6/2002 | Meyer et al. | |
| 6,429,575 | B1 | | 8/2002 | Abramov et al. | |
| 6,491,095 | B1 | * | 12/2002 | Kompanek | 166/249 |
| 6,619,394 | B1 | * | 9/2003 | Soliman et al. | 166/249 |
| 2005/0003737 | A1 | * | 1/2005 | Montierth et al. | 451/5 |

FOREIGN PATENT DOCUMENTS

| | | |
|---|---|---|
| RU | 2026969 C1 | 1/1995 |
| RU | 2026970 C1 | 1/1995 |

* cited by examiner

*Primary Examiner*—David Bagnell
*Assistant Examiner*—Shane Bomar
(74) *Attorney, Agent, or Firm*—The Hecker Law Group, PLC

(57) ABSTRACT

An electro acoustic device and related method for increasing the production capacity of wells that contains oil, gas and/or water is disclosed. The electro acoustic device is submerged in the well producing zone, and includes an electric generator, one or more electro acoustic transducers, and one or more wave guide systems (sonotrodes) that include radiators which transmit vibrations into the medium under treatment. The electro acoustic device produces vibrations that stimulate the occurrence of mass transfer processes within the well. According to one or more embodiments, shear vibrations are produced in the well bore region due to the phase displacement of mechanical vibrations produced along the axis of the well, achieving alternate tension and pressure due to the superposition of longitudinal and shear waves.

28 Claims, 6 Drawing Sheets

ACOUSTIC WELL RECOVERY METHOD AND DEVICE

FIELD OF APPLICATION

Present invention is related to the oil industry, particularly an electro acoustic system and associated method for increasing the production capacity of oil wells and consists in applying mechanical waves in the interior of said wells.

PREVIOUS STATE OF THE ART

The productivity of oil wells decreases in time due to varied reasons. The two main causes have to do with the decrease in the relative permeability of the crude oil, thus decreasing its fluidity, and the progressive plugging of the pores of the reservoir in the well bore region due to accumulation of solids (clays, colloids, salts)that reduce the absolute permeability or interconnection of the pores. The problems associated to the aforementioned causes are: plugging of the pores by fine mineral particles that flow together with the fluid to be extracted, precipitation of inorganic crusts, paraffin and asphaltene decantation, clay hydration, invasion of mud solids and mud filtration, invasion of completion fluids and solids resulting from brine injection. Each one of the reasons just mentioned may cause a decrease in the permeability or a restriction of flow in the region surrounding the well bore.

The well is basically a production formation lined with a layer of cement that in turn holds a series of production tubes placed coaxially within it. The well connects the oil reservoir, which has an appropriate permeability that allows the fluids produced in the formation to flow through perforations or holes in the lining of the well, providing a route within the formation. The tubes provide an outlet for the fluids produced in the formation. Typically there are many perforations which extend radially on the outside from the lined well. The perforations are uniformly spaced out on the lining where it passes through the formation. Ideally, the perforations are placed only in the formation, so the number of these depends on the thickness of the formation. It is quite common to have 9 to 12 perforations per meter of depth in the formation. On the other hand the perforations extend in every longitudinal direction, so there are perforations that can extend radially at an azimuth of 0° while additional perforations are placed each 90° so as to define four groups of perforations around the azimuth.

The fluids of the formation flow through the perforations entering the lined well. Preferably, the well is plugged by some sealing mechanism, such as a packer or bridge plug placed beneath the level of the perforations. The packing connects with the production tube defining a compartment into which the fluid produced from the formation flows, tending to fill it. The accumulated fluid flows from the formation and may be accompanied by variable quantities of natural gas. In summary, the lined compartment accumulates oil, some water, natural gas and also sand and solid residues. Normally the sand settles in the bottom of the compartment. The fluid produced from the formation may change phase in the event of a pressure reduction from the formation which permits lighter molecules to vaporize. On the other hand, the well may also produce very heavy molecules.

After a period of time, the pathways through the perforations extended within the formation may clog with "fines" or residues. This defines the size of the pore that connects with the fluid within the formation, allowing it to flow from the formation, through the cracks or fissures or connected pores, till it reaches the interstitial spaces within the compartment for collection. During this flow, very small solid particles from the formation known as "fines" may flow but instead tend to settle. Whereas the "fines" may be held in a dispersed state for some time, they can group and thus obstruct the space in the pore reducing the production rate of fluids. This can get to be a problem, which in turn feeds upon itself definitely with the decrease in the flow of production. More and more "fines" may deposit themselves within the perforations and obstruct them, tending to prevent even a minimum flow rate.

Even with the best production methods and the most favourable extraction conditions, a percentage higher than 20% of the crude oil originally existing within the reservoir remains behind.

The periodic stimulation of oil and gas wells is made using 3 general types of treatment: acidification, fracturing and treatment with solvents and heat. Acidification involves the use of HCl and HF acid mixtures which are injected into the production zone (rock). The acid is used to dissolve the reactive components of the rock (carbonates and clay minerals and, to a lesser extent, silicates) and thus increase its permeability. Additives such as reaction retardants and solvents are often added to enhance the performance of the acid at work. While acidizing is a common treatment for stimulating oil and gas wells it clearly has some drawbacks, namely the high cost of chemicals and waste disposal costs involved. The acids are often incompatible with the crude oil and may produce thick oily residues within the well. Precipitates formed after the acid is spent may often be more harmful than the dissolved minerals. The depth of penetration of the live acid is usually less than 5 inches.

Hydraulic fracturing is another technique used commonly for stimulation of oil and gas wells. In this process, great hydraulic pressures are used to create vertical fractures in the formation. The fractures may be filled with polymer plugs or treated with acid (in carbonates and soft rocks) to create conduits within the well that allow the oil and gas to flow. This process is extremely expensive (by a factor about 5 to 10 times more than the acid treatment). In some cases the fracture can extend into areas with water, increasing the amount of water produced (undesirable). Such treatments extend many hundreds of feet away from the well and are more commonly used in rocks with a low permeability. The ability to place polymer plugs successfully in all the fracture is usually limited and problems such as fracture closures and plug (proppant) crushing can severely deteriorate the productivity of hydraulic fractures.

One of the most common problems in mature oil wells is the precipitation of paraffin and asphaltene within and around the well. Steam or hot oil is injected into the well to melt and dissolve the paraffin in the oil, making everything flow to the surface. Organic solvents (such as xylene) are often used to remove asphaltenes, whose fusion point is high and are insoluble in alkanes. The steam as well as the solvents are very expensive (solvents more so than the steam) in particular when treating marginal wells that produce less than 10 bbls of oil per day. It should be noted that there are more than 100,000 of such wells only in the state of Texas in the USA.

The prime limitation for use of steam and solvents is the absence of mechanical agitation, required to dissolve or maintain in suspension the paraffin and asphaltenes.

In U.S. Pat. No. 3,721,297 belonging to R. D. Challacombe, a tool is proposed for cleaning the wells by pressure pulses, whereby a series of explosive modules and gas generators are chain interconnected in such a way that the lighting of one of them triggers the next in one succession.

The explosions create shock waves that allow cleaning of the wells. This method has clear drawbacks, such as the potential danger of damaging high pressure oil and gas wells with explosives. This method is made unfeasible by the added risk of fire and lack of control during the treatment period.

The U.S. Pat. No. 3,648,769 belonging to H. T. Sawyer describes a hydraulically controlled diaphragm that produces "sinusoidal vibrations in low sonic range". The waves generated are of low intensity and are not directed or focused at the rock face. In consequence, most of the energy propagates along the borehole.

The U.S. Pat. No. 4,343,356 belonging to E. D. Riggs et al. describes an apparatus for treating surface boreholes. The application of high voltage produces the generation of voltage arcs that dislodge the scale material from the walls of the well. Amongst the difficulties of this apparatus is the fact that the arc cannot be guided continuously, or even if any cleaning is accomplished at all. Additionally the subject of security remains unsolved (electrical and fire problems).

Another hydraulic/mechanical oscillator was proposed by A. G. Bodine (U.S. Pat. No. 4,280,557). Hydraulic pressure pulses created inside an elongated elastic tube are used to clean the lined walls of the wells. This system also suffers from low intensity and limited guiding.

Finally a method for removing paraffin from oil wells was proposed by J. W. Mac Manus et al., (U.S. Pat. No. 4,538,682). The method is based on establishing a temperature gradient within the well by introducing a heating element into the well.

It is well known that the oil, gas and water wells, after some time of operation obstruct and the fluid discharge declines. So it becomes necessary to regenerate wells. The mechanical, chemical and conventional techniques for regenerating wells are the following:

Intensive rinsing

Shock pumping

Air treatment

Dissolution of sediments with hydrochloric acid or other acids combined with other chemicals.

High water pressure hosing

Injection of $CO_2$

Generation of pressure shocks by use of explosives

These methods work with harmful chemicals, or work at such high power that they may be a risk to the structure of the well.

There exist a great number of effects associated to the exposure of solids and fluids to ultrasound fields of certain frequencies and power. Particularly in the case of fluids, it is possible to generate cavitation bubbles, that consists in the creation of bubbles from gasses dissolved in the liquid or from the phase change of this last. Other phenomena associated are the degassing of the liquid and the superficial cleaning of solid surfaces.

Ultrasound techniques have been developed with the aim of increasing the production of crude from oil wells. U.S. Pat. No. 3,990,512 belonging to Arthur Kuris, titled "Method and System for Ultrasonic Oil Recovery", divulges a method and system for recovering oil by applying ultrasound generated by the oscillation produced while cting high pressure fluids and whose aim is to fracture the reservoir so as to produce new drainage canals.

U.S. Pat. No. 5,595,243 belonging to Maki, Jr. et al. proposes an acoustic device in which a set of piezoceramic transducers are used as radiators. This device presents difficulties in its fabrication and use, as it requires asynchronic operation of a great number of piezoceramic radiators.

U.S. Pat. No. 5,994,818 titled "Device for Transferring Ultrasonic Energy into a Liquid or Pasty Medium", and U.S. Pat. No. 6,429,575, titled ""Device for Transmitting Ultrasonic Energy to a Liquid or pasty Medium", both belonging to Vladimir Abramov et al., propose an apparatus consisting of an alternate current generator that operates in the range of 1 to 100 kHz for transmitting ultrasonic energy and a piezoceramic or magnetostrictive transducer that emits longitudinal waves, which a tubular resonator coupled to a wave guide system transforms in turn to transversal oscillations in contact with the irradiated liquid or pasty medium. Notwithstanding, these patents are designed for use in containers of very big dimensions, at least in comparison with the size and geometry of perforations present in oil wells, so we are in presence of limitations in the dimensions as well as in the transmission mode if we want to increase the capacity of production of oil wells.

U.S. Pat. No. 6,230,799 belonging to Julie C. Slaughter et al., titled "Ultrasonic Downhole radiator and Method for Using Same", proposes a device using ultrasonic transducers made in Terfenol-D alloy, placed in the bottom of the well and fed by an ultrasound generator placed at the surface. The disposition of the transducers on the axis of the device allows emitting in a transversal direction. This invention poses a decrease in viscosity of hydrocarbons contained inside the well through emulsification when reacting with an alkaline solution injected into the well. This device considers surface forced fluid circulation as a cooling system, to guarantee irradiation continuity.

U.S. Pat. No. 6,279,653 belonging to Dennos C. Wegener et al., titled "Heavy Oil Viscosity Reduction and Production", presents a method and device for producing heavy oil (API gravity lower than 20) by applying ultrasound generated by a transducer, made with Terfenol alloy, attached to a conventional extraction pump and fed by a generator placed at the surface. This invention also considers the presence of an alkaline solution, like a watery solution of Sodium Hydroxide (NaOH) with an end to generating an emulsion with the crude in the reservoir of lesser density and viscosity, and thereby making it easier to recover by pumping. The difference with the last patent lies in the placing of the transducer in an axial position so as to produce longitudinal emissions of ultrasound. The transducer connects to an adjoining rod that acts as a wave guide to the device.

U.S. Pat. No. 6,405,796 belonging to Robert J. Meyer, et al., titled "Method for Improving Oil Recovery Using an Ultrasound Technique", proposes a method for increasing the recovery of Oil using an ultrasonic technique. The proposed method consists of the disintegration of agglomerates by ultrasonic irradiation posing the operation in a determined frequency range with an end to stimulating fluids and solids in different conditions. The main mechanism of crude recovery is based on the relative movement of these components within the reservoir.

All the preceding patents use the application of ultrasonic waves through a transducer, fed externally by an electric generator, whose transmission cable usually exceeds a length of 2 km. This brings with it the disadvantage of losses in the transmission signal, which means that a signal has to be generated sufficiently strong so as to allow the appropriate functioning of the transducers within the well, because the amplitude of the high frequency variations at that depth decreases to a 10% of the initial value.

As the transducers must work with a high power regime, an air or water cooling system is required, presenting great difficulties when placed inside the well, meaning that the ultrasonic intensity must not be greater than 0.5–0.6 W/cm$^2$. This quantity is insufficient for the purpose in mind as the threshold for acoustic effects in oil and rocks is 0.8 to 1 W/cm$^2$.

The RU patent No. 2,026,969, belonging to Andrey A. Pechkov titled "Method for Acoustic Stimulation of Bottom-hole zone for producing formation, RU No. 2,026,970 belonging to Andrey A. Pechkov et al., titled "Device for Acoustic Stimulation of Bottom-hole zone of producing formation"., U.S. Pat. No. 5,184,678 belonging to Andrey A. Pechkov et al., titled "Acoustic Flow Stimulation Method and Apparatus", divulge methods and devices for stimulating production of fluids from inside a producing well. These devices incorporate as innovative element an electric generator together with the transducer, both integrated at the bottom of the well. These transducers operate in a non continuous regimen allowing them to work without requiring an external cooling system.

A suitable stimulation of the solid materials requires an efficiency in the transmission of the acoustic vibrations from the transducers to the rock of the reservoir, which in turn is determined by the different acoustic impedances inside the well (rocks, water, walls, oil, amongst others). It is well known that the reflection coefficient is high in a liquid-solid interface, which means that the quantity of waves passing through the steel tube will not be the most adequate to act in the interstices of the orifices that communicate the well with the reservoir.

OBJECTIVES OF THE INVENTION

One of the main objectives of present invention is to develop a highly efficient acoustic method that provides a high mobility of fluids in the well bore region.

Another of the main objectives of the invention is to provide a down hole acoustic device that generates extremely high energy mechanical waves capable of removing fine, organic, crust and organic deposits both in and around the well bore.

An additional objective is to provide a down hole acoustic device for oil, gas and water wells that does not require the injection of chemicals to stimulate them.

Another objective is to provide a down hole acoustic device that does not have environmental treatment costs associated with fluids that return to the well after treatment.

At the same time, a down hole acoustic device is required that can function inside a 42 mm tube without requiring to remove or pull said tube.

Finally it is desirable to provide a down hole acoustic device that can be run in any type of completion hole, cased/perforated hole, gravel packed, screens/liners, etc.

DETAILED DESCRIPTION OF INVENTION

Figure 1:
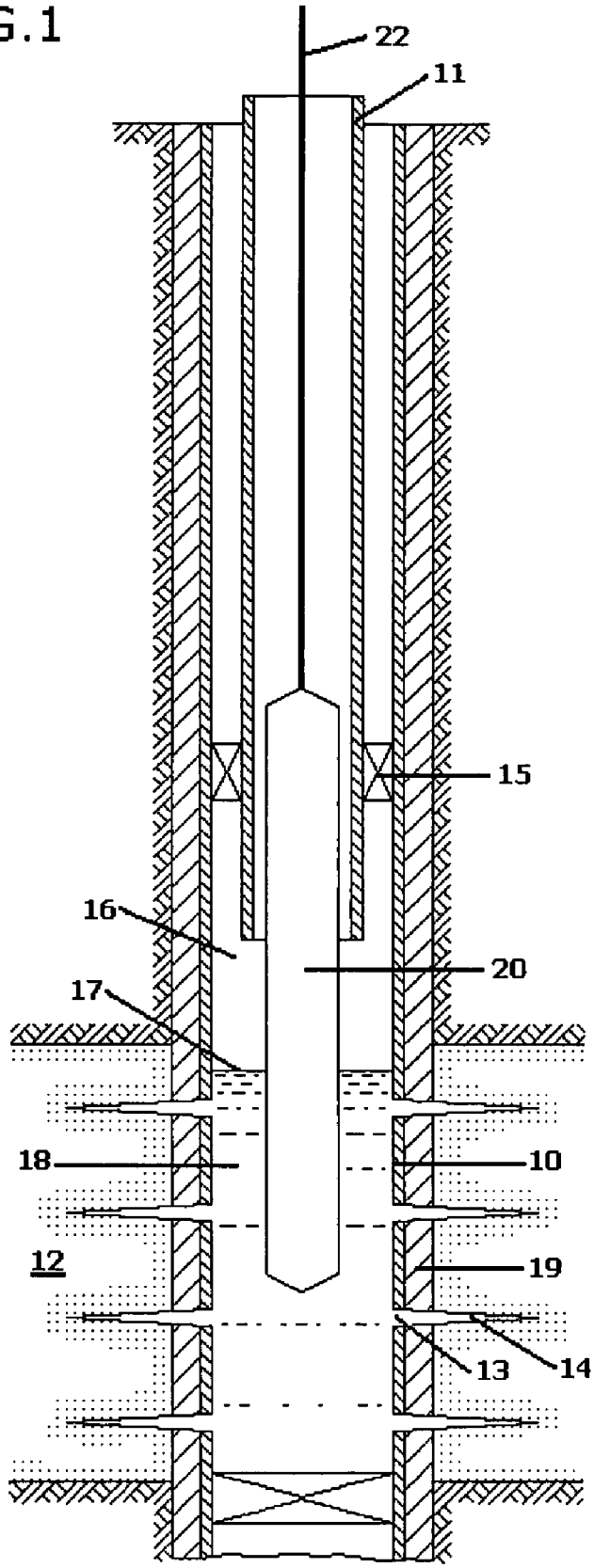
FIG. 1 shows an irradiation device in accordance with proposed invention.

The present invention, (see FIG. 1) with the purpose of increasing permeability of the well bore region (12) of oil, gas and/or water wells, proposes a method and device for stimulating said region (12) with mechanical vibrations, with an end to promoting the formation of shear vibrations in said extraction zone due to the displacement of phase in the mechanical vibrations produced along the axis of the well, achieving alternately tension and pressure due to the superposition of the longitudinal and shear waves, and stimulating in this way the occurrences of mass transference processes within the well.

The oil, gas and/or water wells comprise a metal pipe or casing (10), cement (19) between the casing (10) and the well bore region (12), an inner metal pipe or tubing (11) inside the casing (10), and a packer (15) between the casing (10) and the tubing (11) . The casing (10) near the well bore region (12) is perforated with a machine that produces holes (13) in the casing (10) and fissures (14) in the cement (19) and in the well bore region (12), to allow the fluids from the well bore region (12) to flow to the well. The extraction zone of the well consists of a liquid phase (18) made of oil and/or water, and a gas phase (16) above the level (17) of the liquid phase (18). The electroacoustic device (20) is lowered to the extraction zone of the well with a logging cable (22).

Figures 2A, 2B, 2C, 2D:
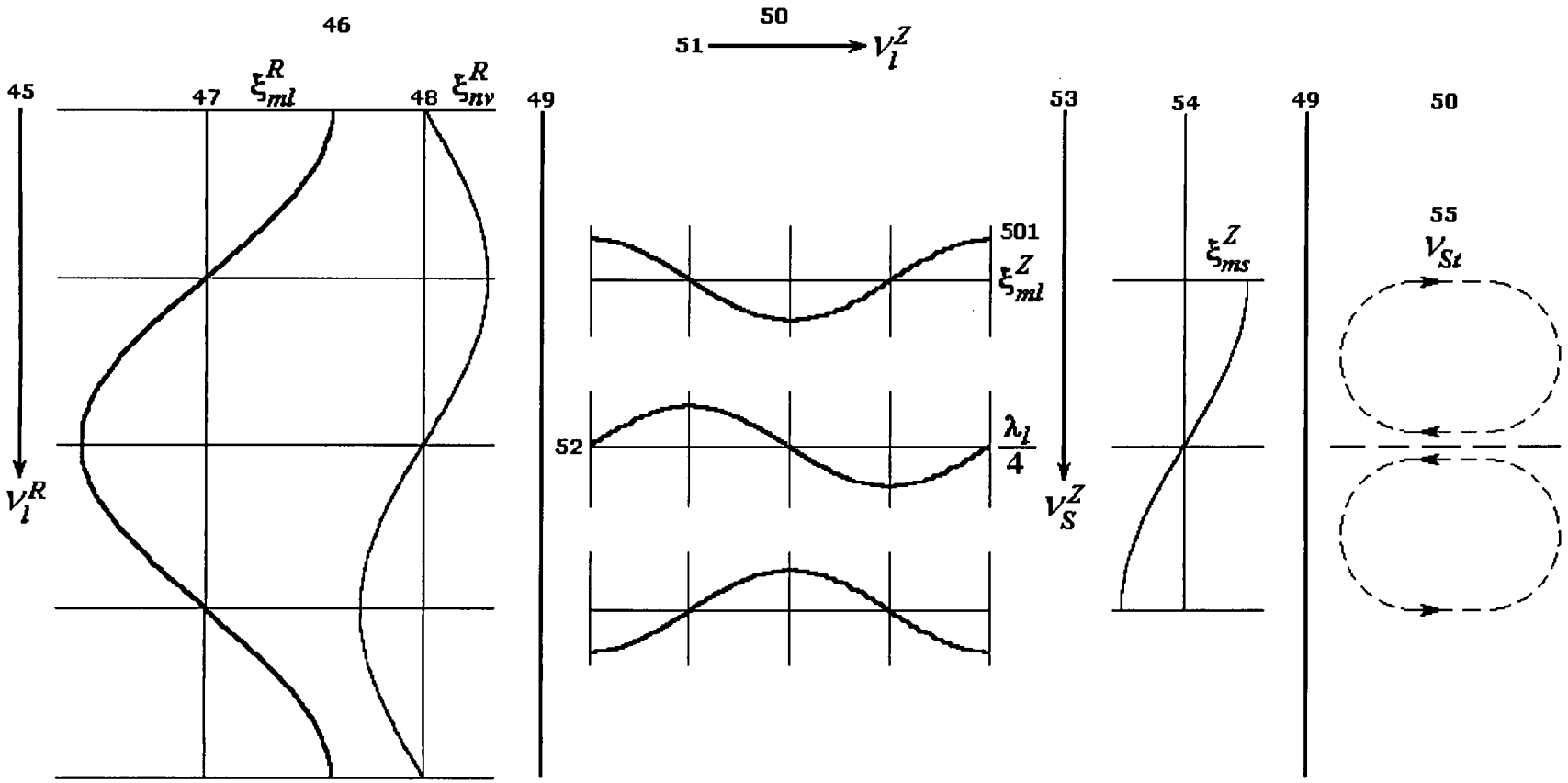
FIGS. 2*a*–2*d* are diagrams illustrating the proposed method.

This last can be illustrated by the diagrams presented in FIGS. 2*a*–2*d*. FIG. 2*a* shows the vector of oscillating velocity $V^R_1$ (45) of longitudinal vibrations that propagate in the radiator (46), is directed along the axis of the radiator, while the amplitude distribution of vibratory displacements $\xi^R_{ml}$ (47) of longitudinal vibrations also propagate along the radiator. In lieu of this, as a result of the Poisson effect, radial vibrations are generated in the radiator (46) with a characteristic distribution with a displacement amplitude of $\xi^R_{nV}$ (48).

FIG. 2*b* shows the radial vibrations through the radiating surface (49) of the radiator (46) are transmitted into the well bore region (50) . The speed vector $V^Z_l$ (51) of the longitudinal vibrations propagate in the well bore region (50) in a direction perpendicular to the axis of the radiator. Waveforms 52 show the characteristic radial distribution of the displacement amplitudes $\xi^Z_{ml}$ (501) of the radial vibrations propagating in the extraction region (50) and radiated from points of the radiator localized at a distance equal to $\lambda/4$ (where $\lambda$ is the wavelength of the longitudinal wave in the radiator material).

FIG. 2*c* shows the phase shift of the radial vibrations propagating in the medium leads to the appearance of shear vibrations in the well bore region, whose vector of oscillating velocity $V^Z_S$ (53) is directed along the radiator axis. Graph 54 shows the characteristic distribution of displacement amplitudes of shear vibrations $\xi^Z_{mS}$.

As a result (see FIG. 2*d*), an acoustic flow (55) is produced in the well bore region (50) due to the superposition of longitudinal and shears waves with speed ($U_f$) and characteristic wavelength $\lambda/4$.

Figure 3:
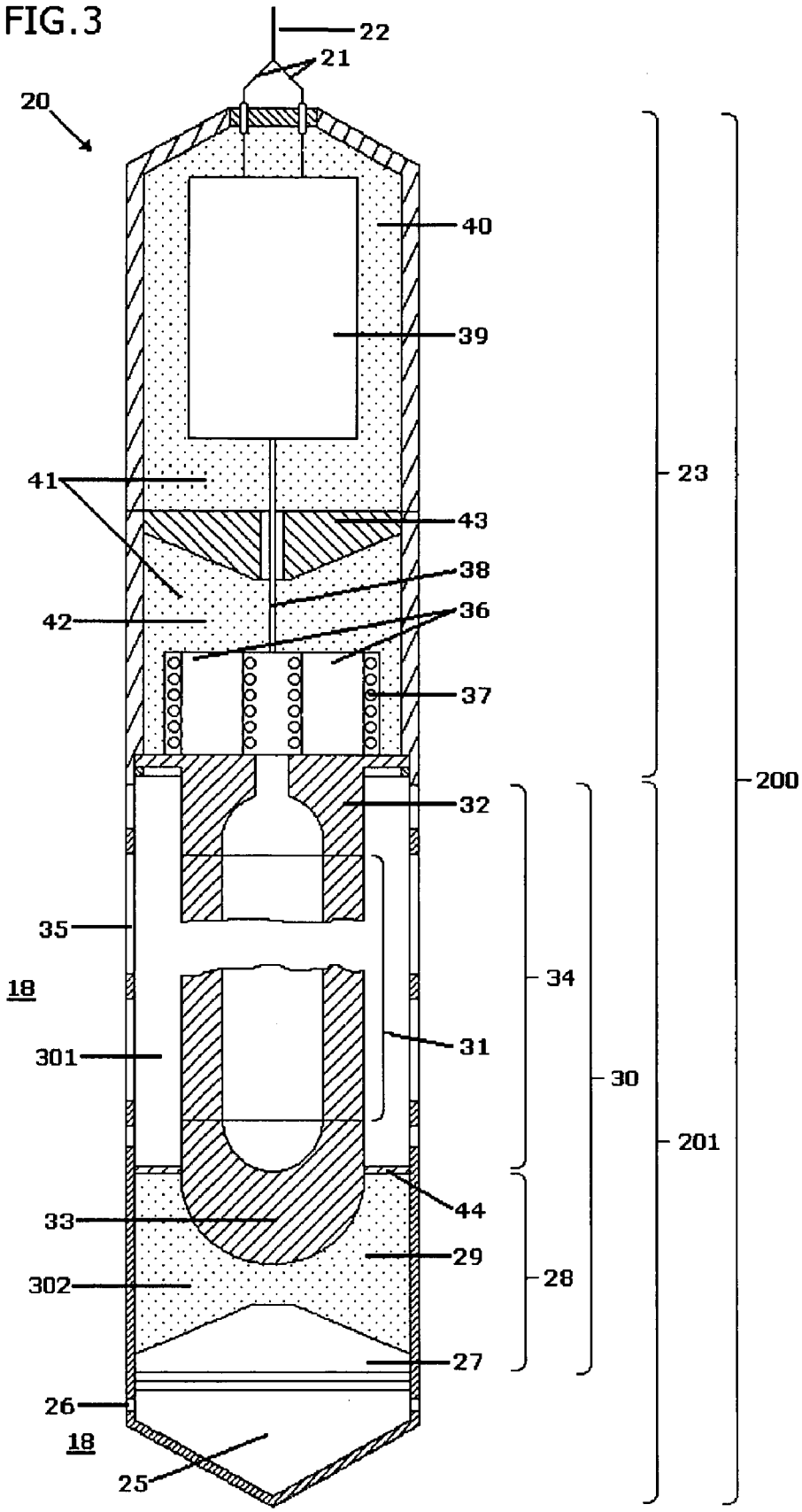
FIG. 3 shows a longitudinal section view through the acoustic unit.

The method described in the preceding paragraphs is implemented, in particular, in the device shown in FIG. 3, where said device is situated within the well.

Therefore, present invention also considers an electroacoustic device (20) which comprises a closed case (200), preferably of cylindrical shape and known as a sonde, which is lowered into the well by an armoured cable (22), comprised preferably by wires, and in which one or more electrical conductors (21) are provided with said armoured cable (22).

The closed case (200) is constructed with a material that transmits the vibrations. The casing (200) has two sections, an upper case (23) and a lower case (201). The lower case (201), at its furthest end has two internal cavities (25) and (302). Cavity (25) communicates with the exterior by means of small holes (26). The fluid (18) to be recovered from the well bore region, may flow through these small holes (26) into the cavity (25) . This fluid, once it has filled the internal cavity (25), allows to compensate the pressure in the well bore region with that of the device (20). The internal cavity (302) is flooded with a cooling liquid (29), which acts on an expansible set of bellows (27), which in turn allow the expansion of it into the compensation area (28) of the lower case (201).

Over the compensation chamber (302), there lies a second chamber (301), named "stimulation chamber", placed in the stimulation zone (34) of the lower case (201). The stimulation zone (34) has holes (35) which allow to increase the level of transmission of acoustic energy to the formation (12).

Both chambers (301 and 302) in turn form a great chamber (30) that houses the wave guide or sonotrode comprising a radiator (31). Said radiator (31) has a tubular geometric shape with an outer diameter $D_0$ its nearer end having the shape of a horn (32) placed within the stimulation chamber (301), while its further end has the shape of a hemisphere (33) with an inner diameter of $D_0/2$, placed inside the compensation chamber (302). Both chambers are sealed by a perimetrical flange (44) which in turn sustains the hemisphere shaped end (33) of the radiator (31). The geometric dimensions of the tubular part of the radiator (external diameter "$D_0$", length "L" and wall thickness "ξ") are determined by the working conditions under resonance parameters of longitudinal and radial vibrations in the natural resonance frequency of the electro acoustic transducer (36).

To implement the above stated principle mentioned before in the description of FIG. 2, about formation of superposition of longitudinal and shear waves in the well bore region, length "L" of the tubular piece of the radiator must not be less that half the length of the longitudinal wave λ in the radiator material, which is $L \geqq \lambda/2$.

The horn (32) is welded to the transducer (36), which preferably should be a magnetostrictive or piezoceramic transducer, surrounded by a coil (37).

To better the cooling system, the electro acoustic transducer (36) is constructed in two parts (not shown in FIG. 3.

The coil (37) is connected adequately with an electrical conductor (38) extended from the power source (39) placed in a separate compartment (40) within the upper case (23). The power source (39) is fed from the surface of the well by conductors (21) in the logging cable (22). The power source (39) and the transducer (36) are cooled with liquids (41) existent in compartments that contain them (40 and 42 respectively). The compartments (40 and 42) are separated by a perforated disk (43).

Figure 4:
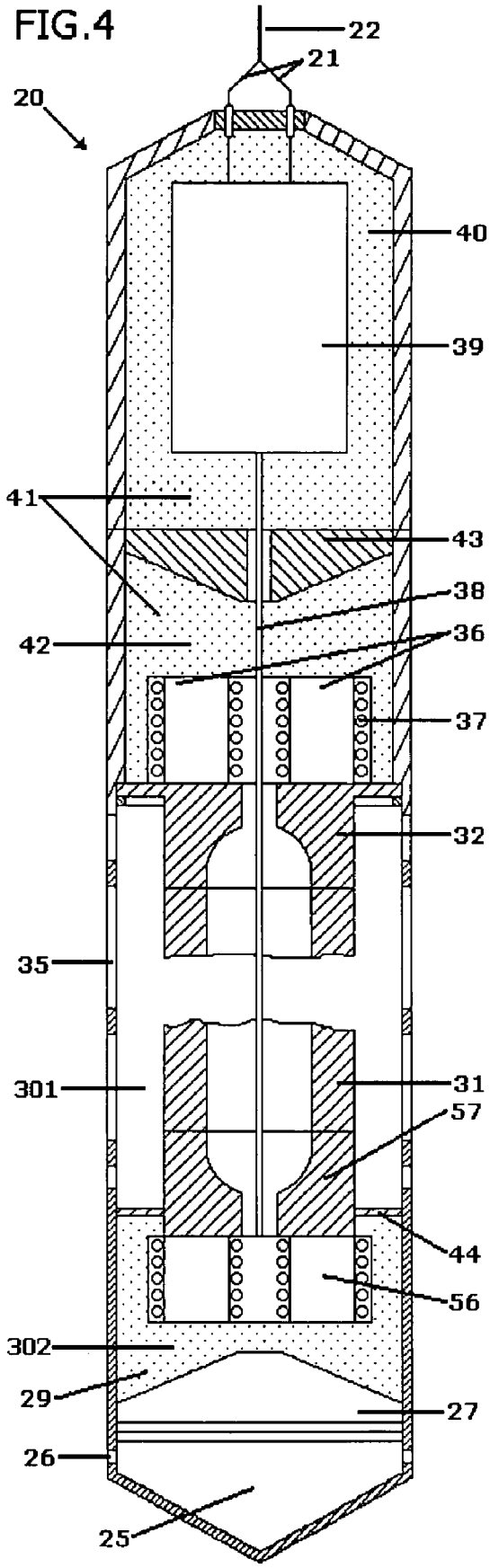
FIG. 4 shows a more detailed diagram of the second modality of the acoustic unit of present invention.

To increase the acoustic power supplied to the well bore region, another electro acoustic transducer (56) operating in phase with the first transducer (36) is added to the device (20) shown in FIG. 4, meanwhile the power source (39) is connected to both transducers (36 and 56) with a common feeding conductor (38).

The radiator (31) takes on a tubular shape with both ends finishing in a half wave horn shape (32 and 57).

Figure 5:
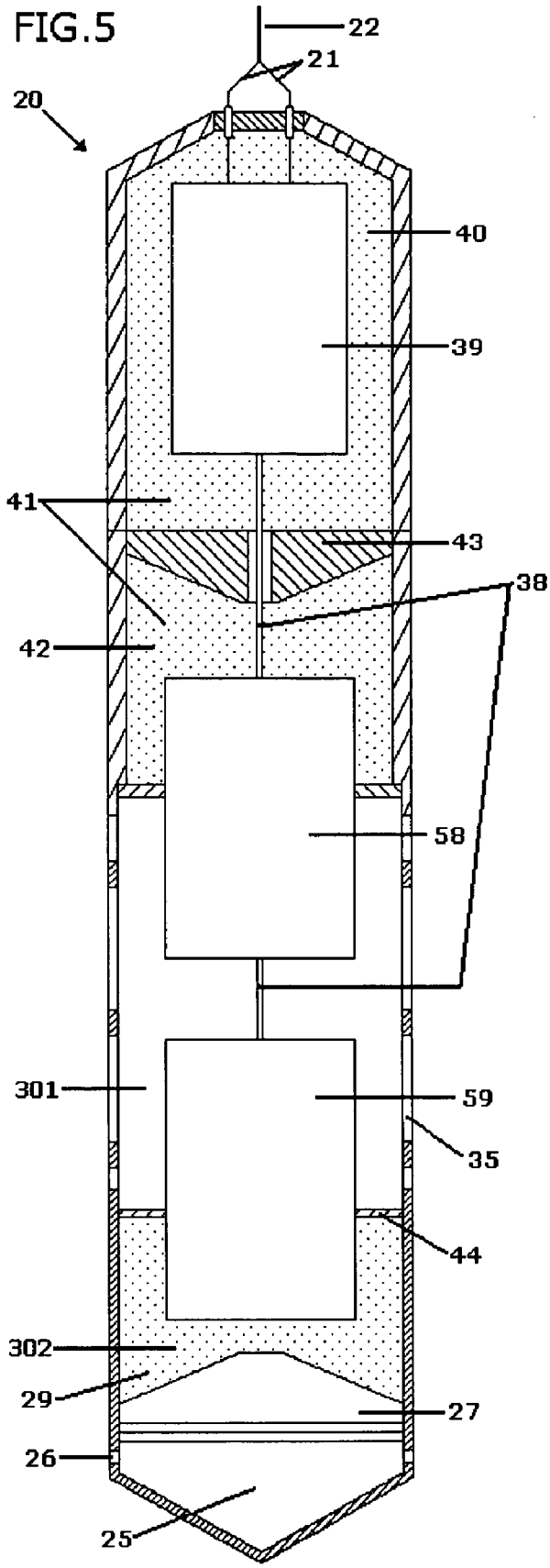
FIG. 5 shows a diagram of the third modality of the acoustic unit of present invention.

FIG. 5 shows another modality for developing the specified principle for formation of longitudinal and shear waves in the well bore region, where the electro acoustic device (20) includes 2 or 2n (where n is a whole number) vibratory systems (58 and 59), for which the electro acoustic transducers of each pair operate in phase and every pair next to the vibratory system operates in antiphase with respect to the previous vibratory system.

The power source (39) is connected to the transducers of each vibratory system (58 and 59) with a common feeding conductor (38).

The other elements for constructing this system are analogous to those described previously in FIG. 3.

Figure 6:
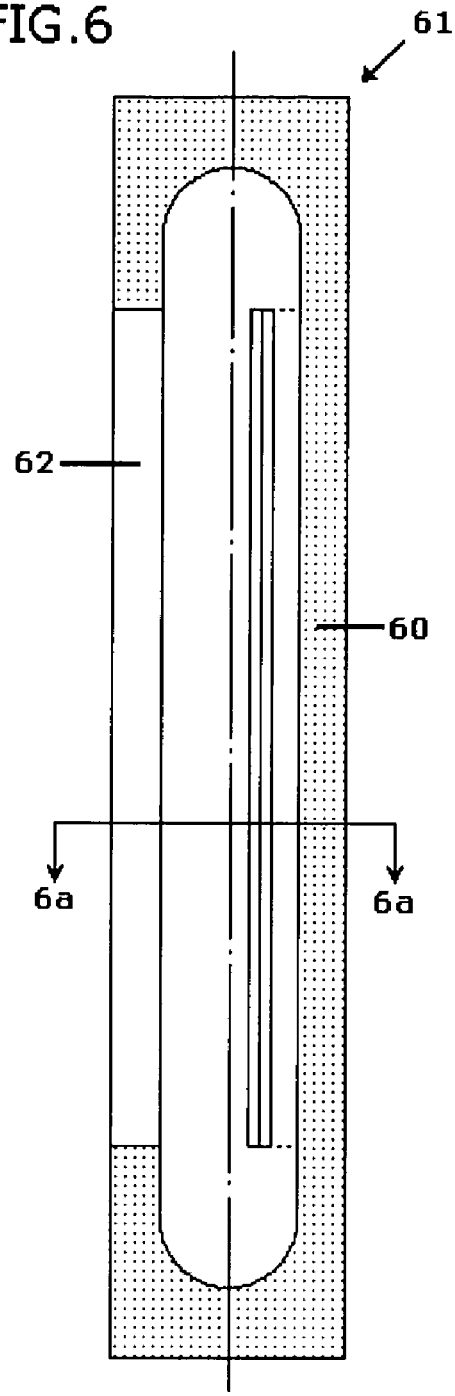
FIG. 6 is a sectional view through the fourth modality of the irradiation device.
Figure 6A:
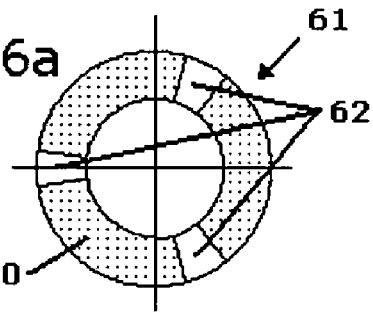
FIG. 6*a* is a cross section of FIG. 6 along the line A—A.

To increase the operating efficiency of a tubular radiator, its construction is modified in the way shown in FIGS. 6 and 6*a*.

In the case shown in FIGS. 6 and 6*a*, the tubular radiator (61) has a cylindrical housing (60) in which some longitudinal grooves (62) are designed, varying in number from 2 to 9. The length of these grooves (62) is a multiple of half the λ wavelength in the radiator material, while its width may vary in a range of 0.3 $D_0$ to 1.5 $D_0$.

What is claimed:

1. A method for increasing the production capacity of wells that contain oil, gas and/or water by stimulating mass transference processes within said well, said method comprising:

immersing an electro acoustic device in a well bore region of a well, said electro acoustic device comprising a sonotrode and an electro acoustic transducer, said sonotrode having a tubular geometric shape with an irradiation surface developed along an axis of said well, wherein dimensions of said tubular geometric shape are determined by operating conditions under resonance parameters of longitudinal and radial vibrations in a natural resonance frequency of said electro acoustic transducer;

using said electro acoustic device to introduce mechanical vibrations in said well bore region along the axis of said well, producing shear vibrations in the well bore region due to displacement of phase of said mechanical vibrations, achieving alternately tension and pressure by superposition of longitudinal and shear waves; and providing a plurality of grooves in a generatrix of said sonotrode, wherein said grooves are placed parallel to a longitudinal axis of said sonotrode, and said grooves have a groove length that is a multiple of half the wavelength generated and a groove width in the range of approximately 0.3 to 1.5 times a diameter of said sonotrode.

2. The method of claim 1, wherein the superposition of said longitudinal and shear waves provide an acoustic flow with speed $U_f$ and wavelength λ/4.

3. The method of claim 1 further comprising:

forming a vibratory system comprising two or more electro acoustic transducers operating in phase, connected to said sonotrode at distances that are multiples of half the wavelength of longitudinal and radial waves generated.

4. The method of claim 3, further comprising:

providing an even number of vibratory systems in said electro acoustic device, wherein the electro acoustic transducers of each vibratory system operate in phase, and adjacent vibratory systems operate in antiphase with respect to each other.

5. The method of claim 1, further comprising:

configuring a first end of said sonotrode in the shape of a horn and a second end in the shape of a hemisphere with an inner diameter that is one-half the diameter of said tubular geometric shape.

6. The method of claim 1, wherein said electro acoustic transducer is of a magnetostrictive type.

7. The method of claim 1, wherein said electro acoustic transducer is of a piezoelectric type.

8. An electro acoustic device for increasing the production capacity of wells that contain oil, gas and/or water by stimulating mass transference processes within said wells, said electro acoustic device comprising:

an electro acoustic transducer; and a sonotrode having a tubular geometric shape with an irradiation surface developed along an axis of a well, wherein dimensions of said tubular geometric shape are determined by operating conditions under resonance parameters of longitudinal and radial vibrations in a natural resonance frequency of said electro acoustic transducer, said sonotrode comprising a first end having the shape of a horn and a second end having the shape of a hemisphere with an inner diameter one-half the diameter of said tubular geometric shape;

wherein said electro acoustic device is configured to introduce mechanical vibrations in a well bore region along said axis of said well, producing shear vibrations in the well bore region due to displacement of phase of said mechanical vibrations, achieving alternately tension and pressure by superposition of longitudinal and shear waves.

9. The electro acoustic device of claim 8, wherein said superposition of longitudinal and shear waves provide an acoustic flow with speed $U_f$ and wavelength $\lambda/4$.

10. The electro acoustic device of claim 8, wherein said electro acoustic transducer is of a magnetostrictive type.

11. The electro acoustic device of claim 8, wherein said electro acoustic transducer is of a piezoelectric type.

12. The electro acoustic device of claim 8, comprising:

a vibratory system comprising a plurality of electro acoustic transducers operating in phase, wherein said plurality of electro acoustic transducers are connected to said sonotrode at distances that are multiples of half the wavelength of longitudinal and radial waves generated.

13. The electro acoustic device of claim 12, comprising an even number of said vibratory systems, wherein the electro acoustic transducers of adjacent vibratory systems are configured to operate in antiphase with respect to each other.

14. The electro acoustic device of claim 8, wherein said sonotrode comprises a plurality of grooves in its generatrix.

15. The electro acoustic device of claim 14, wherein said grooves are placed parallel to a longitudinal axis of said sonotrode, and have a groove length that is a multiple of half the wavelength generated and a groove width in the range of approximately 0.3 to 1.5 times a diameter of said sonotrode.

16. An electro acoustic device for increasing the production capacity of wells that contain oil, gas and/or water by stimulating mass transference processes within said wells, said electro acoustic device comprising:

an electro acoustic transducer; and a sonotrode having a tubular geometric shape with an irradiation surface developed along an axis of a well, wherein said sonotrode comprises a first end adjacent to said electro acoustic transducer, said first end having the shape of a horn, and a second end having the shape of a hemisphere with an inner diameter one-half the diameter of said tubular geometric shape;

wherein said electro acoustic device is configured to introduce mechanical vibrations in a well bore region along said axis of said well, producing shear vibrations in the well bore region due to displacement of phase of said mechanical vibrations, achieving alternately tension and pressure by superposition of longitudinal and shear waves.

17. A method for increasing the production capacity of wells that contain oil, gas and/or water by stimulating mass transference processes within said well, said method comprising:

immersing an electro acoustic device in a well bore region of a well, said electro acoustic device comprising a sonotrode and an electro acoustic transducer, said sonotrode having a tubular geometric shape with an irradiation surface developed along an axis of said well, wherein dimensions of said tubular geometric shape are determined by operating conditions under resonance parameters of longitudinal and radial vibrations in a natural resonance frequency of said electro acoustic transducer;

using said electro acoustic device to introduce mechanical vibrations in said well bore region along the axis of said well, producing shear vibrations in the well bore region due to displacement of phase of said mechanical vibrations, achieving alternately tension and pressure by superposition of longitudinal and shear waves; and configuring a first end of said sonotrode in the shape of a horn and a second end in the shape of a hemisphere with an inner diameter that is one-half the diameter of said tubular geometric shape.

18. The method of claim 17, wherein the superposition of said longitudinal and shear waves provide an acoustic flow with speed $U_f$ and wavelength $\lambda/4$.

19. The method of claim 17 further comprising:

forming a vibratory system comprising two or more electro acoustic transducers operating in phase, connected to said sonotrode at distances that are multiples of half the wavelength of longitudinal and radial waves generated.

20. The method of claim 19, further comprising:

providing an even number of vibratory systems in said electro acoustic device, wherein the electro acoustic transducers of each vibratory system operate in phase, and adjacent vibratory systems operate in antiphase with respect to each other.

21. The method of claim 17, wherein said electro acoustic transducer is of a magnetostrictive type.

22. The method of claim 17, wherein said electro acoustic transducer is of a piezoelectric type.

23. An electro acoustic device for increasing the production capacity of wells that contain oil, gas and/or water by stimulating mass transference processes within said wells, said electro acoustic device comprising:

an electro acoustic transducer; and a sonotrode having a tubular geometric shape with an irradiation surface developed along an axis of a well, wherein dimensions of said tubular geometric shape are determined by operating conditions under resonance parameters of longitudinal and radial vibrations in a natural resonance frequency of said electro acoustic transducer;

wherein said electro acoustic device is configured to introduce mechanical vibrations in a well bore region along said axis of said well, producing shear vibrations in the well bore region due to displacement of phase of said mechanical vibrations, achieving alternately tension and pressure by superposition of longitudinal and shear waves;

said sonotrode comprising a plurality of grooves in its generatrix, wherein said grooves are placed parallel to a longitudinal axis of said sonotrode, and have a groove length that is a multiple of half the wavelength generated and a groove width in the range of approximately 0.3 to 1.5 times a diameter of said sonotrode.

24. The electro acoustic device of claim 23, wherein said superposition of longitudinal and shear waves provide an acoustic flow with speed $U_f$ and wavelength $\lambda/4$.

25. The electro acoustic device of claim 23, wherein said electro acoustic transducer is of a magnetostrictive type.

26. The electro acoustic device of claim 23, wherein said electro acoustic transducer is of a piezoelectric type.

27. The electro acoustic device of claim 23, comprising:

a vibratory system comprising a plurality of electro acoustic transducers operating in phase, wherein said plurality of electro acoustic transducers are connected to said sonotrode at distances that are multiples of half the wavelength of longitudinal and radial waves generated.

28. The electro acoustic device of claim 27, comprising an even number of said vibratory systems, wherein the electro acoustic transducers of adjacent vibratory systems are configured to operate in antiphase with respect to each other.

* * * * *